United States Patent [19]

Coltman et al.

[11] Patent Number: 4,947,944

[45] Date of Patent: Aug. 14, 1990

[54] DEVICE FOR STEERING A DRILLING TOOL AND/OR DRILL STRING

[75] Inventors: Trevellyn M. Coltman; Alfred E. W. Fletcher, both of Pretoria, South Africa; Bernhard Prevedel, Hanover, Fed. Rep. of Germany

[73] Assignee: Preussag Aktiengesellschaft, Hanover, Fed. Rep. of Germany

[21] Appl. No.: 327,961

[22] PCT Filed: Jun. 14, 1988

[86] PCT No.: PCT/DE88/00359

§ 371 Date: Feb. 15, 1989

§ 102(e) Date: Feb. 15, 1989

[87] PCT Pub. No.: WO88/10355

PCT Pub. Date: Dec. 29, 1988

[30] Foreign Application Priority Data

Jun. 16, 1987 [ZA] South Africa ..... 87/4318
Jun. 16, 1987 [ZA] South Africa ..... 87/4319

[51] Int. Cl.[5] ..... E21B 7/08; E21B 7/10
[52] U.S. Cl. ..... 175/73; 175/325
[58] Field of Search ..... 175/325, 73, 61, 74, 175/76; 166/241

[56] References Cited

U.S. PATENT DOCUMENTS

| | | | |
|---|---|---|---|
| 2,179,567 | 11/1939 | Strength | 175/73 |
| 2,316,409 | 4/1943 | Downing | 175/73 |
| 2,592,277 | 4/1952 | Hammer | 175/371 X |
| 3,062,303 | 11/1962 | Schultz | 175/73 |
| 3,104,134 | 9/1963 | Nielsen et al. | 175/325 |
| 3,180,436 | 4/1965 | Kellner et al. | 175/325 X |
| 4,102,416 | 7/1978 | Hug | 175/227 |
| 4,284,154 | 8/1981 | England | 175/325 |
| 4,407,374 | 10/1983 | Wallussek et al. | 175/73 X |
| 4,606,417 | 8/1986 | Webb et al. | 175/325 X |
| 4,638,873 | 1/1987 | Welborn | 175/325 |
| 4,842,082 | 6/1989 | Springer | 175/325 X |

FOREIGN PATENT DOCUMENTS

| | | | |
|---|---|---|---|
| 2620801 | 12/1976 | Fed. Rep. of Germany . | |
| 3325962 | 1/1985 | Fed. Rep. of Germany . | |
| 3534662 | 4/1987 | Fed. Rep. of Germany . | |
| 751956 | 7/1980 | U.S.S.R. | 175/325 |
| 2134162 | 8/1984 | United Kingdom . | |

*Primary Examiner*—Hoang C. Dang
*Attorney, Agent, or Firm*—Herbert Dubno

[57] ABSTRACT

An outer tube (26) provided with rolling bearings (28) is rotatably mounted on an inner tube (10) which can be connected to a drilling tool or a pipe string. Radially mobile guiding rails are arranged in longitudinal channel-like recesses on the outer surface of the outer tube (26). Belleville springs lodged in spring housings (36) arranged in recesses in the guide rails (35) press against the outer tube (26) and force the guide rails (35) radially outward. The guide rails (35) help prevent rotation of the outer tube, enable it to slide longitudinally in the bore, and guide the inner tube (10) mounted in the outer tube (26) and the drilling tool or pipe string attached to the inner tube (10).

18 Claims, 3 Drawing Sheets

DEVICE FOR STEERING A DRILLING TOOL AND/OR DRILL STRING

FIELD OF THE INVENTION

The invention concers a device for steering a drill bit and/or a drill string For performing drilling operations consisting of an Internal pipe connectable to the drilling tool or a drill string, and an outer pipe rotatably supported on the same and provided with steering shoes.

BACKGROUND OF THE INVENTION

Devices of this type serve the function of stabilizing the drill tool or the drill string in the drilled hole and to counteract deviations of the drill bit from the preset drilling direction. Undesirable deviations occur particularly in the transition zones between harder and softer layers in deep-hole drilling, especially if the drill crosses these layers at an acute angle.

Up to now it has been known to achieve stabilization of the drill tool through the incorporation of steering devices, so-called course indicator rods or stabilizers. These are rod-type pipes mounted with steering shoes, the outer diameter of which corresponds to the drilling diameter, and follow the drill bit, steering it in a concentric manner. Such devices are available in various designs, for example rigid designs, where the stabilizing shoes are rigidly connected to the multiple drill rod unit and rotate in the drill hole, or those of the type first mentioned, where the stabilizing shoes are provided on a separate outer pipe in which the multiple drill rod unit is positioned for rotation. Target drill rods are already available for vertical drilling, with built-in automatic vertical steering utilizing gravitational force and using the pressure of the flushing fluid or the rotation of the drill rods to develop steering pressure Known rigid steering devices have the disadvantage that they counteract the deviation of the drill tool from the drilling direction only to an insufficient extent. A reason for this is the fact that the diameter of the drilling tool must always be dimensioned a little larger than the diameter of the steering device in order to avoid jamming of the steering device in the drill hole. This is important above all because the diameter of the drill hole may diminish because of the wear of the drill bit. Therefore, known steering devices are not always urged tightly against the drill hole wall during the drilling process, so that the drilling tool may wander off course.

OBJECTS OF THE INVENTION

An object of the present invention is to create a steering device of the type mentioned first, which permits precise steering of the drill tool and drill string in operation and where the risk of jamming in the drill hole is avoided.

SUMMARY OF THE INVENTION

According to the invention this object is attained by providing the steering shoes in a radially movable manner in slotlike recesses in the outer pipe of the device and by providing, between the floor of the recesses and the bottom side of the steering shoes means of changeable position or shape, with which the steering shoes can be pressed against the hole wall In this way the steering shoes can be firmly pressed against the hole wall because their relative positions can be adjusted to variations of the drill hole diameter. Therefore, the steering shoes remain constantly in contact with the drill hole wall and in this manner provide sufficient stabilization of the drill tool and thereby more exact observance of the preset drilling direction.

Preferably the means for pressing the steering shoes against the hole wall consist of prestressed compression springs which are provided between the bottom side of the steering shoes and the floor of the recess in the outer pipe. The compression springs may be cup springs, spiral springs or flat springs. Furthermore, according to the invention the steering shoes may be kept in position in the recesses by screws which engage in tapped holes in the outer pipe and the heads of which are arranged in countersunk manner in stepped or shoulder holes in the steering shoes. With the aid of these screws it is possible to limit the largest possible outer diameter up to which the outer sides of the steering shoes can extend, where the compression springs may have already a specific prestressing force with this position of the steerings shoes.

Preferably the screws pass through spacer tubes located in the shoulder holes and against which the heads of the screws can be tightened. In this manner the screws can be safeguarded against loosening. Furthermore, the length of the spacer tubes accurately define the maximum outer diameter covered by the steering shoes.

For the positioning of the compression springs, blind holes are provided preferably at the bottom side of the steering shoes, into which the pressure springs extend. This results in a sufficiently large installation space in order to permit a relatively flat characteristic curve.

In an advantageous embodiment of the invention, the movable positioning between the inner pipe and the outer pipe can make use of two slide bearings with radially and axially acting sliding surfaces. Such a bearing is characterized by a low radial structural height and is insensitive to high temperatures.

According to another embodiment of the invention the movable position between the inner pipe and the outer pipe may make use of two tapered roller bearings which are supported at axial shoulders of the outer pipe and held with safety nuts on the inner pipe. Such bearings require small radial structural space and permit loading in an axial direction so as to receive high radial forces. With the aid of safety nuts it is possible to set the play of the bearings accurately and it is also possible to adjust manufacturing tolerances. The ends of the outer pipes are sealed to the inner pipe, preferably by means of slip ring packings. A suitable lubricant can be used for lubricating the bearing, by filling the ring space between outer and inner pipes, which is separated from the slip ring packing. In addition, the ring space filled with a lubricant may be connected to a pressure equalization device, which is exposed to the pressure in deep-well drilling. The pressure balance thereby obtained between the ring space and its surrounding, leads to a relief of the slip ring packings whereby their useful life is prolonged. According to the invention the pressure balancing device may consist of at least one flexible wall, for example a bellows or a membrane, which is provided at the wall of the outer pipe. According to another feature of the invention the pressure equalization device may also consist of an axially movable and sealed piston which is limited in movement in a longitudinal bore in the inner pipe.

A further embodiment of a device according to the invention can be used to correct deviations of the drilling tool from the predetermined drilling direction. According to the invention this is achieved by providing a bottom side of a steering shoe or the floor of a recess which is inclined toward the longitudinal axis of the device and by providing a wedge with a correspondingly inclined surface between the steering shoe and the floor of the recess which is movable in a longitudinal direction through a setting device. By adjusting the wedge it is possible to change the position of the steering shoe in a radial direction to such an extent that the device and the drilling tool connected with the device may be dislocated from the center of the drilled hole in order thereby to correct the drilling direction. Preferably the device for changing the drilling direction features at one level several steering shoes equally distributed as to their circumference, which can be adjusted with the aid of a wedge. These bars can be adjusted in a coordinated manner in order to be able to move the device in every direction.

Preferably the setting device features a female nut gear coupled to an electrically driven final adjustment motor. In addition, a hydraulic generator driven by the flushing flow is provided to generate the driving energy. The generator is driven in accordance with the invention, preferably by a flushing turbine which is provided in the flushing passage running through the inner pipe.

The adjustment of the steering shoes with the aid of wedges and electrically driven setting devices according to the invention offers the advantage that the achievable adjusting forces are largely independent of the flushing pressure and that the guiding forces supported at the steering bars may amount to a multiple of the producible controlling forces because the steering shoes are supported mechanically over the wedge in a direct manner at the outer pipe. Since the driving energy is produced for moving the controlling devices with the aid of a flushing flow, the device according to the invention can also be used with nonrotating drill rods for aligning the drill bit.

The adjusting devices can be controlled with the aid of telemetric devices from above ground according to the invention. However, it is also possible to provide an automatic control of the device in such a manner that a measuring device is provided in a recess in the wall of the outer pipe to ascertain the drilling direction with a controlling device connected to the measuring device which processes the measured results, controlling the adjusting devices for maintaining the preset drilling direction. The measuring device may feature an inclinometer and/or a direction meter such as a gyroscope or magnetometer.

Another embodiment of the invention may have the outer pipe of the device provided with several steering shoes biased by pressure springs at one end, and at the other end of the outer pipe several, preferably three, steering shoes adjustable with the aid of wedges. With this arrangement the one end which faces the drill string of the device is guided centrally in the drill hole, while the other end, connected to the drilling tool, can be relocated in random direction toward the centre of the drilling hole, in order to correct the drilling direction.

In a simplified embodiment of the device according to the invention a steering shoe impacted by compression springs is provided at the opposite side of a steering shoe adjustable through a wedge. The steering shoe adjustable with the aid of a wedge is pressed by a force of reaction of the pressure springs supported at the opposite steering shoe. This has the advantage that in the event of a defect of the control devices it is possible to pull the steering device easier, since the pressure springs permit a reduction of the outer diameter of the steering shoes.

BRIEF DESCRIPTION OF THE DRAWINGS

Further aspects and advantages of the present invention will appear from the following description taken together with the accompanying drawing in which.

Figure 1:
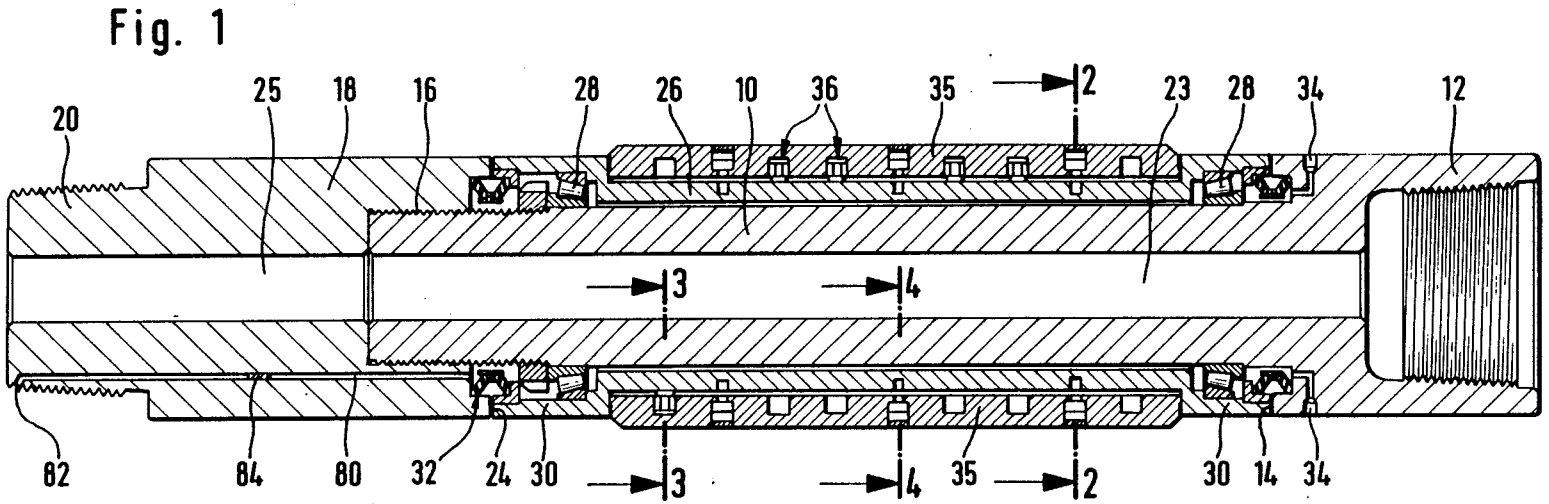
FIG. 1 is a longitudinal section through a device of the invention for guiding and stabilizing the drill string in the hole.

The embodiment illustrated in FIG. 1 includes a drill string element 10 which is formed with a threaded socket or sleeve 12 at its leading end and with a rearwardly directed shoulder 14 near the leading end. The trailing end of the element 10 is threaded at 16. The socket 12 is capable of receiving, in a threaded connection, a threaded pin at the trailing end of a leading drill string element while the threaded section 16 is connected to a trailing drill string element 18 forming part of the stabilizer of the invention. The trailing end of the element 18 is formed as a threaded pin 20 which can be received by a threaded socket at the leading end of another drill string element.

Together, the elements 10 and 18 form part of the drill string and serve to convey thrust and rotation to a drill bit carried at the leading end of the foremost drill string element in the drilled hole. Flushing passages 23 and 25 are formed in the elements 10 and 18.

Located rotatably between the shoulder 14 and a shoulder 24 at the leading end of the element 18 is a tube-shaped body 26. Taper roller bearings 28 provide for free rotation between the body 26 and the drill stem element 10, the bearing housings 30 being sealed by means of seals 32. The bearing housings 30 at the leading end of the body 26 are provided with nipples 34 for the introduction of lubricating and sealing oil or grease into the housings.

Figure 4:
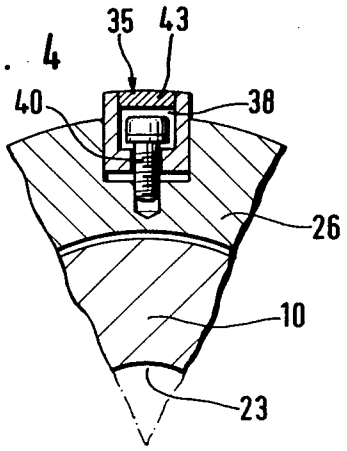
FIG. 4 is a partial section along the line 4—4 in FIG. 1.
Figure 3:
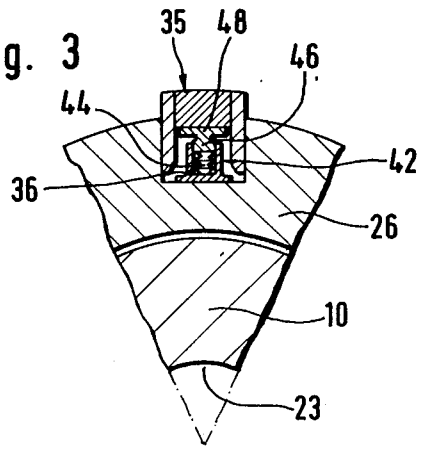
FIG. 3 is a partial section along the line 3—3 in FIG. 1.
Figure 2:
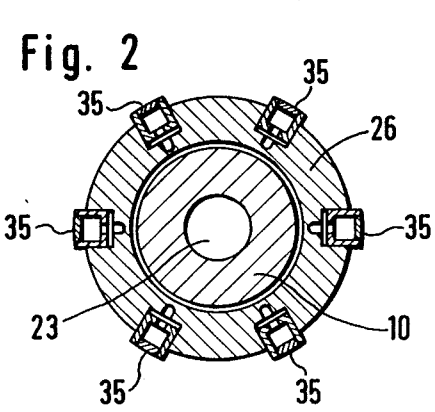
FIG. 2 is a section along the line 2—2 in FIG. 1.

The body 26 carries a series of steering shoes 35, in this case six, which are elongated in shape and which extend in the longitudinal direction. As illustrated in FIGS. 3 and 4, each shoe is formed with a series of spring housings 36 and with a series of cavities 38. Cap screws 40 have their heads located in the cavities 38, have their shanks threaded into preformed holes in the body 26 and serve to connect the shoes to the body. Plugs 43 close off the cavities 38.

Fixed to the body 26 inside each spring housing 36 is an element 42 presenting a pot which locates a pin 46 carried by an element 48 carried by the shoe. Belleville washers or cup springs 44 are located in the pot between the bottom of the pot and the extremity of the pin and serve to bias the shoes 35 radially outwardly from the body.

At the commencement of drilling operations, the cap screws are set for the stabilizer to locate in a frictionally tight manner in the collar. Drilling can now commence with the body 26 and its shoes remaining rotationally fast in the hole and following the drill bit down into the hole. In practice, a number of stabilizers of the kind described above will be positioned at intervals in the drill string to stabilize the string and keep the drill bit on course.

As drilling proceeds and the bit wears, the diameter of the drilled hole will decrease. The Belleville washers permit the shoes to move radially inwardly to take account ot this. Due to the material surrounding the hole, the diameter of the hole can also increase. This can also he compensated by expanding of the Belleville washers 44 and radially outward movement oF the shoes. Since the shoes 35 of the device according lo the invention can be replaced easily after the plugs 43 and the cap screws 40 have been remoVed the device can be adapted to different diameter drill bits in a simple way by using shoes of different thickness. Thus the device can be used for drilling holes with various diameters as well.

An important feature of the illustrated stabiliser is the provision of a passage 80 which extends from the bearing housing 30 to the trailing end of the element 18 where a breather plug 81 is provided. Located in the passage 80 there is a floating piston 84.

The passage 80 and piston 84 are provided to equalise the pressures on the bearing housing 30. This pressure differential is alleviated by appropriate movement of the piston 84. Therefore, the bearing housing and, above all, the seals are not exposed to remarkable pressure differentials during deep-well drilling.

Figure 5:
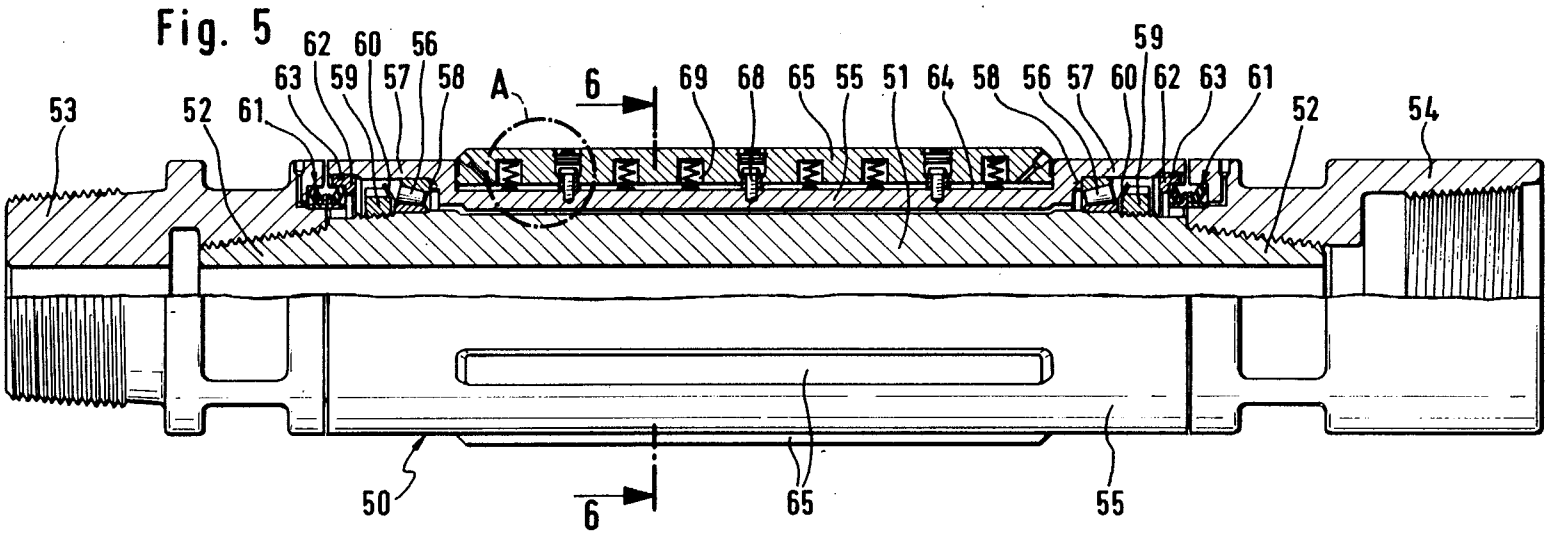
FIG. 5 is a semi-longitudinal section through an other embodiment of a device of the invention for drilling string.

Reference is now made to FIG. 5 showing an embodiment of a steering device 50 which features a hollow drilling string element 51 which, at both its ends, is equipped with male threaded ends 52 to be coupled to the female threaded end sockets of a male drill string connection element 53 and a female drill string connection element 54. The unIt comprising elements 51, 53 and 54 can be inserted between two rod pipes of a drill string and in this manner form part of a drilling string by wich torque and feeding and rotating motion can be conveyed to the drill bit.

A tube-shaped body 55 is mounted rotatably on the drill string element 51 between the opposed shoulders of connection element 53 and connection element 54. Body 55 is journalled for rotation on element 51 by conical roller bearings 56 which are located in bearing housings 57 forming shoulders 58 at both ends of the body 55. Bearings 56 rest against the shoulders 58 of the body 55 turned away from each other, in axial direction. The tapered roller bearings 56 are located relative to the drill string element 51 in axial direction with the aid of safety nuts 59 and safety collars 60. The safety nuts 59 are screwed onto an outer threading of the element 51. At both ends of the body 55 packing elements 61 are provided engaged in ring grooves in the shoulders of connection elements 53 and 54.

The housings 62 for packing elements 61 are sealed by O-rings 63 against the body 55.

On its outer side body 55 carries six steering shoes 65 of elongated shape, each of the shoes extends in longitudinal direction and engage in recesses 64 in the wall of body 55. The steering shoes are equipped with stepped holes 66 which receive shoulder casings 67 which in turn receive screws 68 passing therethrough into threaded engagement in holes in the bottom of the recesses 64. .The length of the shoulder casings 67 is dimensioned so that the steering shoes 65 can move by preset amounts in radial manner in the recesses. The steering shoes 65 are prevented from protruding out of the recesses 64 by the shoulders of the shoulder cases 67 engaging enlarged sections of the stepped holes 66. The steering shoes 65 also feature spring chambers 69 which are formed by blind holes located opposite the bottom of the recess 64. Prestressed thrust springs 70 are provided in the spring chambers. The threaded holes 66 are locked toward the outside by plugs 75.

Figure 6:
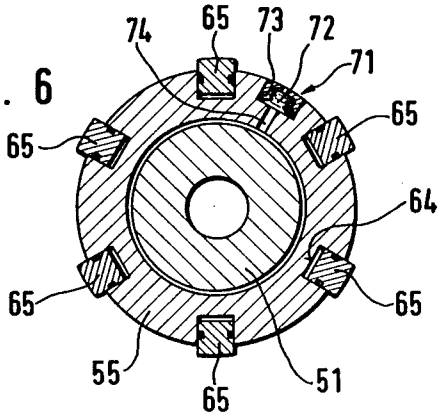
FIG. 6 is a cut along the line 6—6 in FIG. 5.

The sectional view in FIG. 6 shows a pressure compensation device 71 in the wall of the body 55. Device 71 consists of a siphon gland 72 and a support 73, which are mounted into hole 74. Through a connecting borehole 74 the compensating device 71 is connected to the interior of the bearing housings 57 via the ring space between drill string element 51 and body 55. Device 71 thus provides compensation between the lubricant pressure and the ambient pressure.

Figure 7:
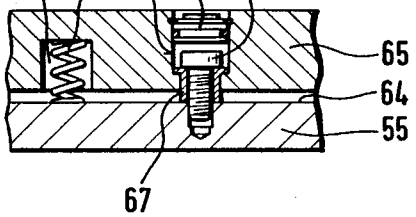
FIG. 7 is an enlarged section "A" in FIG. 5.

During drilling the embodiment shown in the FIGS. 5 to 7 is used in the same advantageous manner as the embodiment according to FIGS. 1 to 4. With the embodiment of FIGS. 5 to 7 it is possible to vary the required radial mobility of the steering shoes 65 by selecting the proper length of the shoulder sleeves 67. It is also possible to mount steering shoes of different thickness.

Figure 8:
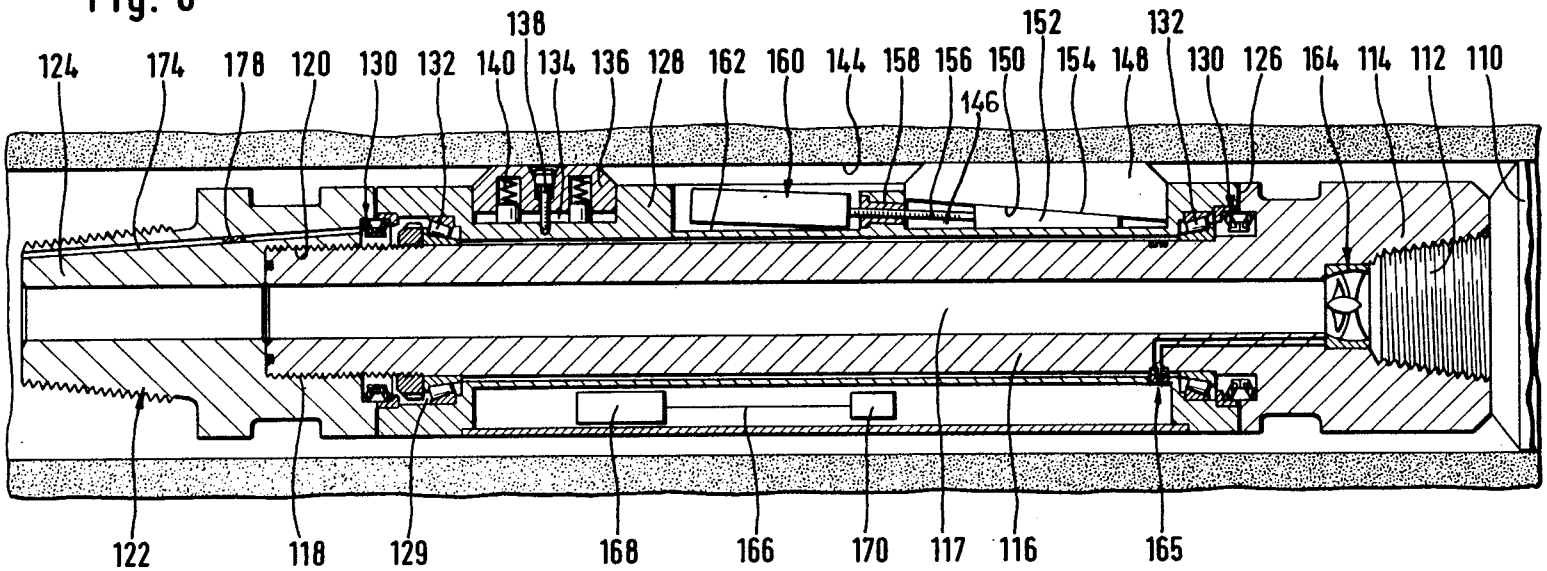
FIG. 8 is a longitudinal section through a device of the invention for steering and controlling a drilling tool.

In FIG. 8 a drill bit is indicated with the reference numeral 110 The bit 110 has a trailing, threaded pin 112 which is located in a threaded box 114 at the leading end of a round cylindrical drill stem 116 which has an axial flushing passage 117. The trailing end of the stem 116 is externally threaded at 118 and is located in a complementally threaded socket 120 in a body 122 which has a trailing, threaded pin 124 for location in a threaded box at the leading end of the remainder of the drill string (not illustrated).

Figure 9A:
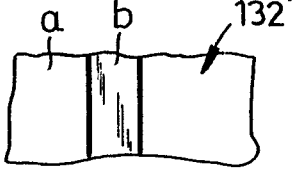
FIG. 9A is a highly diagrammatic view of a sliding bearing with radially and axially acting gliding surfaces.

Located between a shoulder 126 of the stem 116 and the leading end of the body 122 is another body 128 of round tubular form, the body 128 locating rotatably on the middle region of the stem 116. Sealing arrangements 130 are provided between the stem and the body 128 to prevent leakage between them. Also, taper roller bearings 132 are provided for transferring the axial thrust required for drilling. Instead of taper roller bearings 132, other suitable bearings 132' (FIG. 9A), having mutually slidable radially and axially sliding surfaces defined by parts a and b, such as slide bearings may be used. The body 122 and the stem 116 transmit the rotation and torque which are required for driving the drill bit 110.

The body 128 has three equispaced pockets 134 in which steering shoes 136 are located only one such pocket and shoe being visible in FIG. 8. The shoes 136 are connected loosely to the body 128 by means oF pins 138 and are outwardly biased by compression springs 140. Clearly, as the drill string rotates so do the body 122 and the stem 116, the body 128 remaining stationary with its shoes 136 in contact with the wall of the drilled hole 144.

The body 128 also has a further three equispaced pockets 146 only one of which is seen in FIG. 8. Each of the pockets 146 accommodates a steering shoe 148 which has a tapered base 150. A tapered wedge 152 enters the pocket 146 behind the shoe 148, its tapered surface 154 riding on the base 150 of the shoe. The trailing end of the wedge is connected to a threaded rod 156 passing through an internally threaded collar 158 accommodated within the thickness of the wall of the body 128. The rod is in turn connected to the output shaft of a reversible motor and gearbox combination 160 housed in a cavity 162 in the thickness of the wall of the body 128. The motor is an electrical motor which is powered by means of a turbine driven generator indicated generally with the numeral 164 an having its rotor located in the flushing passage 117. The electric energy oF the turbine driven generator 164 is transmitted from the rotating stem 116 to the stationary body 128 by means oF rigid means and slide ring connectors 165. Clearly when the motor is driven the wedge is moved in the axial direction whereby the position oF the shoe 148 is changed. It will be appreciated that the arrangement of motor, gearbox, wedge, rod and so Forth is provided for each of the three shoes 148.

The wall of the body 128 includes a further cavity 166 in which a gyroscope 168 is accommodated. Signals from the gyroscope are fed to a control unit 170 located in the cavity 166. The gyroscope receives its driving power from the turbine 164 and is designed to detect the situation when the drill bit wanders from the desired course. Signals from the gyroscope are processed in the control unit which issues an appropriate drive signal to one or more of the motors.

Figure 9:
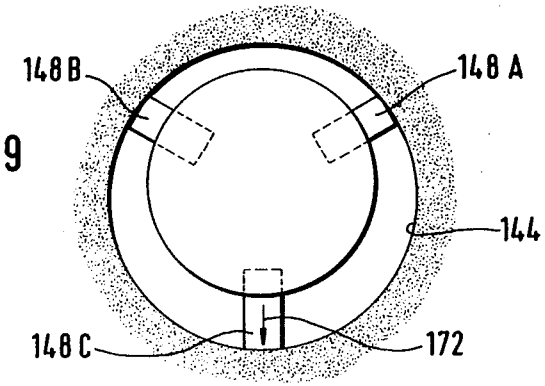
FIG. 9 is a schematic presentation of the movement of the stabilizing shoes in the event of an adjustment of the drilling direction in the device according to FIG. 8.

In practice, each of the motors will receive an appropriate drive signal. FIG. 9 illustrates the situation when the drill hole 144 has deviated from the vertical in the direction on the arrow 172. The control unit processes the signals from the gyroscope and signals the motors associated with the shoes 148A and 148B to go into reverse drive. In the result, the wedges are withdrawn to a certain extent, as determined by the control unit, to permit the shoes 148A and 148B to move radially inwardly. At the same time, the control unit signals the motor associated with the other shoe 148C to go into normal drive with the result that the wedge is driven further into the relevant pocket 146 and the shoe 148C is urged radially outwardly. Upon stabilization of the apparatus in the drilled hole, the bit will be brought back to the predetermined, vertical drilling direction.

Depending on the deviation from the predetermined drilling direction different control signals will be processed to move the wedges of the shoes.

In some cases it may be necessary to move two of the shoes 148 radially outwardly to steer the bit back onto the vertical course.

In the specific embodiment just described, it is desired to drill a vertical hole. In other embodiments, it may be preferred to drill hole horizontally or at another angle to the vertical. Of course the gyroscope, or for that matter, any other direction sensing device, can be set to detect wanderIng oF the drilling direction from any chosen direction. A further feature of the embodiment illustrated in FIG. 8 is the provision oF a narrow passage 174 which leads from the housing in which the bearings 132 and sealing arrangements 130 are provided to the trailing end of the pin 124 where it communicates with the periphery of the pin. Located in this passage is a floating piston 178. By appropriate movement of the piston 178 in the passage pressure differentials between the ambient pressure and the pressure in the chamber 129 of the bearings are compensated.

We claim:

1. An apparatus for steering a drilling tool along a wall of a drilling bore, comprising:

an inner pipe rotatable about a longitudinal axis;

an outer pipe mounted rotatably on said inner pipe and coaxial with said inner pipe, said outer pipe being formed with an outer surface facing the wall of the bore and being provided with a plurality of slots spaced angularly from one another in said outer pipe, each of said slots having a respective bottom;

a respective wedge slidable axially in the respective slot and having a guiding surface spaced from the bottom of the respective slot, said guiding surface being inclined to said axis;

a respective motor operatively connected with each of said wedges for sliding the respective wedge axially in the respective slot; and a respective shoe having a respective inner portion received in each of said slots and formed with a shoe bottom inclined complementary to said guiding surface of the respective wedge and in a constant contact with said guiding surface, each of said shoes being radially movable upon sliding of the respective wedge by the respective motor and protruding beyond said peripheral wall of said outer pipe.

2. The apparatus defined in claim 1 wherein each of said motors is an electric motor connected by a threaded spindle and nut drive with the respective wedge.

3. The apparatus defined in claim 2 wherein said inner portion of the respective shoe is abutted simultaneously and constantly by a pair of flanks of the respective slot extending radially inwardly from said outer surface of said outer pipe and defining said bottom of the respective slot, so that said shoe is axially immovable relative to said outer pipe.

4. The apparatus defined in claim 2, further comprising a generator for generating electrical energy for said motors, said inner pipe being provided with a flushing passage and said generator being located in said flushing passage.

5. The apparatus defined in claim 4 wherein said generator includes a turbine having a rotor provided in said flushing passage.

6. The apparatus defined in claim 2, further comprising a measuring device operatively connected with a control device for operating the respective motor.

7. The apparatus defined in claim 6 wherein said outer pipe is provided with a recess receiving said measuring device connected with said control device in said recess, said control device processing an output signal of said measuring device for controlling the respective motor for maintaining a predetermined drilling direction.

8. The apparatus defined in claim 6 wherein said measuring device is an inclinometer.

9. The apparatus defined in claim 6 wherein said measuring device is a directional meter.

10. The apparatus defined in claim 2, further comprising another plurality of steering shoes spaced angularly from one another, each shoe of said other plurality of steering shoes being received by a respective groove formed in said outer pipe and spaced axially from the respective slot.

11. The apparatus defined in claim 10, further comprising prestressed replaceable springs provided between an inner portion of the respective steering shoe of said other plurality and a bottom of the respective groove.

12. The apparatus defined in claim 11 wherein said steering shoe of said other plurality is screwed to said outer pipe by screws engaged in an threaded bore holes in said outer pipe with a head of the screw received in a countersunk manner in shoulder holes provided in each of said steering shoes of said other plurality.

13. The apparatus defined in claim 11 wherein each of said steering shoes of said other plurality is formed with a respective screw sleeve extending radially toward said axis and having shoulders parallel to said axis against which the respective screw is tightened.

14. The apparatus defined in claim 11 wherein each of said steering shoes of said other plurality is formed at least with one blind hole extending radially in said underside of the respective shoe and receiving the respective prestressed spring.

15. The apparatus defined in claim 2 wherein said inner and outer pipes have a rotary bearing therebetween, said rotary bearing including two slide bearings each having radially and axially acting sliding surfaces.

16. The apparatus defined in claim 2 wherein said outer pipe has a front end and a rear end, said ends being sealed to said inner pipe by slide ring packings.

17. The apparatus defined in claim 16 wherein said slide ring packings are connected to a pressure equalization device exposed to the ambient pressure in said drilling bore to equalize pressure in said slide ring packings with the ambient pressure.

18. The apparatus defined in claim 17 wherein said pressure equalization device includes a sealed piston.

* * * * *